United States Patent [19]

Falk et al.

[11] Patent Number: 4,794,772

[45] Date of Patent: Jan. 3, 1989

[54] AXIAL WAFER TUMBLER LOCK AND KEY

[75] Inventors: Sidney Falk; James M. Alex, both of River Grove, Ill.

[73] Assignee: K.X.L. Manufacturing, Inc., River Grove, Ill.

[21] Appl. No.: 166,204

[22] Filed: Mar. 10, 1988

[51] Int. Cl.[4] ..... E05B 27/08

[52] U.S. Cl. ..... 70/491; 70/377

[58] Field of Search ..... 70/363, 376, 377, 392

[56] References Cited

U.S. PATENT DOCUMENTS

| | | | |
|---|---|---|---|
| 1,375,521 | 4/1921 | Lasky | 70/363 |
| 1,384,392 | 7/1921 | Laski | 70/363 |
| 2,493,630 | 1/1950 | Julliard | 70/339 |
| 2,557,028 | 6/1951 | Deutsch | 70/363 |
| 3,237,476 | 3/1966 | Williams | 70/363 |
| 3,408,840 | 11/1968 | Hasenbein | 70/363 |
| 3,605,461 | 9/1971 | Frank | 70/367 |
| 3,661,001 | 5/1972 | Glass | 70/388 |

*Primary Examiner*—Robert L. Wolfe

*Attorney, Agent, or Firm*—Leydig, Voit & Mayer

[57] ABSTRACT

An improved tubular axial wafer tumbler lock that can be fully automatically manufactured and assembled along with a cast combinated key at very low cost without machining operations is made up of three basic components including a shell, spindle plug and rear cap wherein generally T-shaped wafer tumblers are held in open notches in the spindle plug by springs and a multipurpose cam stop washer at the forward end retains the tumblers in the plug during assembly and after assembly conceals the outside readability of the tumbler lock-up combinations as well as defining the rotational limits of travel of the sprindle plug. A lockup of the lock is accomplished with forward and rearward notches tha co-act with radial blade portions of the tumblers and the notches are disposed at 15° increments which thereby provide 24 of such notches to permit a large variety of different key pulls. The low cost, mass producible lock construction lends itself to numerous specialty applications where the internal components can be incorporated into different shells loaded from the rear as well as from the front with a fixed head or a removable bezel and thereby even enable the combination of a cam lock and switch lock.

12 Claims, 4 Drawing Sheets

FIG. 11
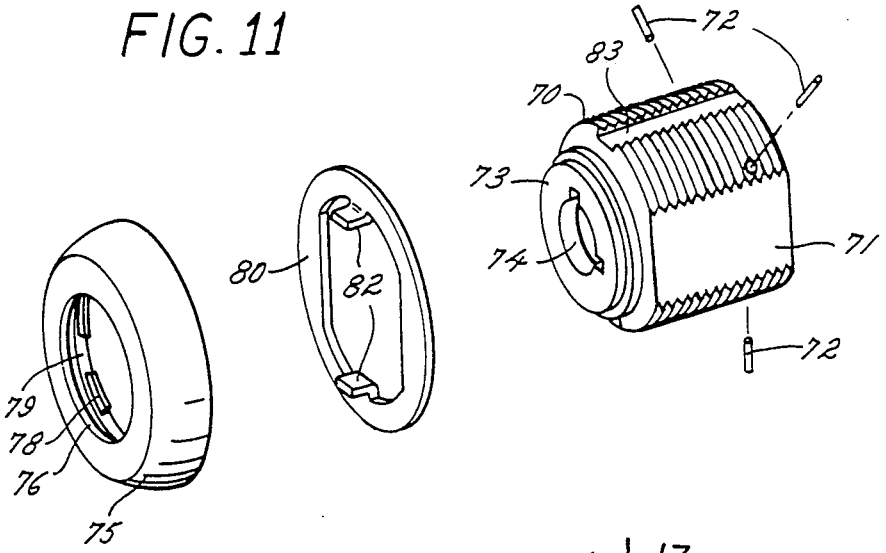
FIG. 12
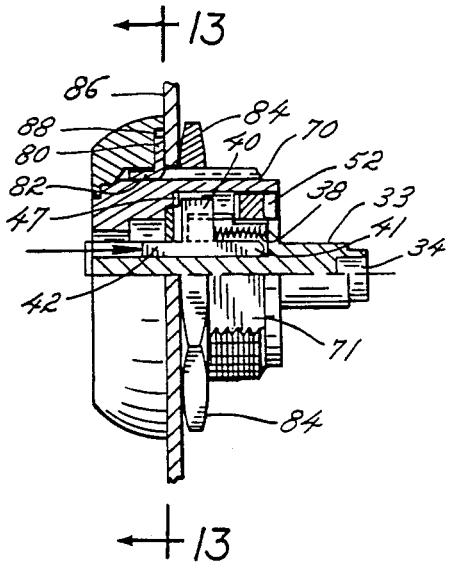
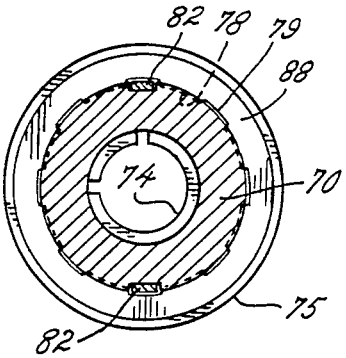
FIG. 13

AXIAL WAFER TUMBLER LOCK AND KEY

BACKGROUND OF THE INVENTION

1. Field of the Invention

The present invention relates generally to axial tumbler locks, and, more particularly, relates to an improved type of construction for tubular wafer tumbler locks which can be automatically manufactured and assembled along with a cast combinated key at very low cost without machining operations. The preliminary form of such a lock was disclosed in Disclosure Document No. 165575, filed in the U.S. Patent and Trademark Office on March 9, 1987.

2. Description of the Prior Art

U.S. Pat. No. 3,237,436 discloses a tubular lock structure of the type with which the present invention is concerned. The lock of that patent has been in commercial use. While that lock did provide the desirable aspects of manufacture and assembly without machining operations as well as the capability of casting a corresponding combinated key, there were several areas of deficiency with respect to the construction and manner of assembly of the components which limited the versatility of the lock. Also, the particular component structures did not readily lend themselves to fully automated assembly to minimize manufacturing costs for achieving optimum advantages of this type of tubular lock construction.

SUMMARY OF THE INVENTION

It is the general aim of the present invention to provide an improved axial wafer tumbler lock construction which is extremely low in cost to manufacture without machining operations and automatically assemblable economically in high volumes.

A related object is to provide an improved wafer tumbler tubular lock, the components of which including cast combinated keys can be readily produced for multi-purposes and with greatly increased versatility for the basic lock construction.

It is a further object of this invention to provide an improved tubular wafer tumbler lock of the above type which enables an increased number of key combinations to be incorporated as well as allowing system-keying and master-keying of such a low cost, high volume producible lock.

These and other objects of this invention are realized by providing a basic three-component construction including a shell, spindle plug and rear cap wherein generally T-shaped wafer tumblers are held in open notches in the spindle plug by springs and a multi-purpose cam stop washer retains the forward end of the tumblers in the plug during assembly and then after assembly serves to conceal the outside readability of the tumbler lock-up combinations while also defining the rotational limits of travel of the spindle plug.

In the preferred embodiment of the invention, the spindle plug carries six wafer tumblers which are combinated with respect to first splines at the forward end of the shell and second splines on the forward face of a cap at the rearward end which allows lock up and key pulls at 15° increments. In addition, the rearward cap has rearwardly facing notches that enable varying angular positioning of a lock plug assembly within special purpose shells. In an exemplary embodiment, such a shell is provided where the lock assembly can be inserted from the front and held in place with a removable bezel ring that has internal splines acting with a lock washer provided with forwardly projecting lugs that serve to prevent removal of the bezel when the lock structure is mounted onto an application surface. The structural arrangement of the lock construction of the present invention, for example, readily lends itself to various speciality applications such as the combination of a cam lock and switch lock which can be provided at extremely low cost even for such highly specialized desired applications.

BRIEF DESCRIPTION OF THE DRAWINGS

The invention and further objects and advantages thereof will be made apparent by reference to the ensuing description when taken in conjunction with the drawings, wherein:

FIG. 11 is an exploded perspective view of an alternative shell embodiment incorporating the components of the lock of the present invention, here showing a removable front bezel and lock washer arrangement;

FIG. 12 is a side elevational view partly in section of an assembled and mounted lock utilizing the removable bezel shell of FIG. 11;

FIG. 13 is a view taken along the line 13—13 in FIG. 12;

DESCRIPTION OF THE PREFERRED EMBODIMENTS

Figure 1:
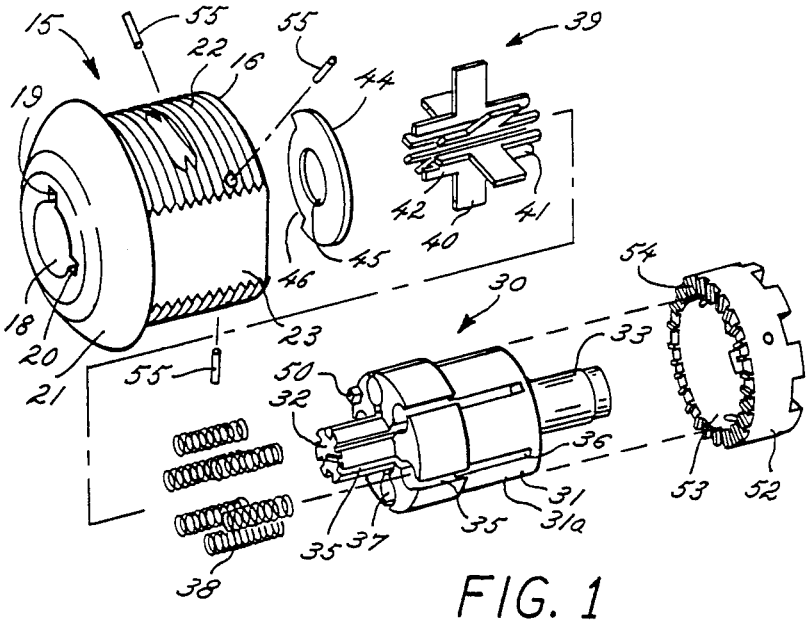
FIG. 1 is an exploded perspective view of certain components of the tubular axial wafer tumbler lock according to the preferred embodiment of this invention.
Figure 4:
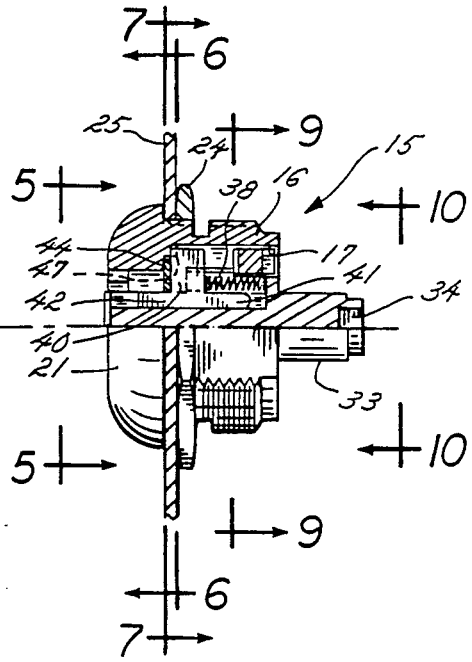
FIG. 4 is a side elevational view partly in section of a tubular wafer tumbler lock constructed according to the preferred embodiment of this invention.
Figure 5:
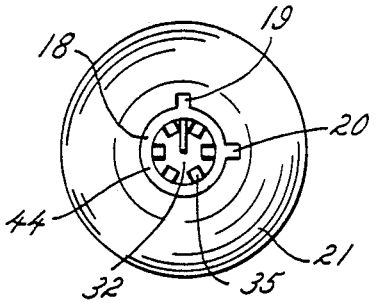
FIG. 5 is a vertical elevation view taken along the line 5—5 of FIG. 4.

Referring collectively now to drawings, in FIGS. 1, 4 & 5, there is shown a tubular axial wafer tumbler lock construction in accordance with a preferred embodiment of this invention. The lock generally indicated at 15 includes an outer tubular shell 16 which has a longitudinal cylindrical bore 17 extending forwardly from its rear end as viewed from the right in FIG. 4. A second smaller diameter cylindrical bore 18 extending inwardly from the left as viewed in FIG. 1 defines a circular key opening and as here shown includes two rectangular shaped notches 19, 20 at the 12 o'clock and 3 o'clock positions for key entry and removal, respectively.

The shell 16 also includes an enlarged head or bezel 21, here integrally formed with the shell which is also provided with a raised threaded section 22 extending rearwardly from the head and both sides of the body are provided with longitudinally extending flats 23. The foregoing structure serves for mounting the lock mechanism in a similarly shaped opening of a panel or door or the like in a conventional manner such as securing in place by a nut 24 which engages the threaded body and is tightened against the opposite side of a mounting surface 25 as illustrated in FIG. 4.

As the discussion proceeds, it will be apparent to those skilled in the art that the outer shell configurations may be varied according to any desired applications, types of mounting or external appearances either specialty or conventional.

Turning to the operational components of the lock, the principle rotational element is an unitarily constructed tumbler cylinder or spindle plug generally indicated at 30 which has a cylindrical tumbler receiving portion 31 dimensioned to be rotatably received by the shell bore 17. A reduced diameter key receiving shaft 32 projects forwardly of the tumbler cylinder 31 and a reduced diameter actuator shaft 33 projects rearwardly from the tumbler cylinder 31. In the present instance the actuator shaft 33 is shown as being non-threaded with a recess 34 thereon such as may be typically used with a switch stem (not shown). The actuating shaft, however, may take a variety of different forms as may be desired for connecting or coupling the shaft to a mechanical latch element or an electrical switch operating element.

The key shaft 32 has a plurality of circumferentially spaced radial grooves or slots 35 formed therein which extend longitudinally along the key shaft and into the tumbler cylinder 31 with the grooves leaving slot openings in both the key shaft and tumbler cylinder. The slots 35 do not pass completely through the rearward end of the tumbler cylinder 31, but instead leave blind ends 36. Each of the slots 35 in the tumbler cylinder includes a longitudinally extending bore 37 for receiving a tumbler spring 38 that can be dropped into the bores from the top with the tumbler cylinder in an upright position.

In accordance with one of the features of the present invention, the tumblers generally indicated at 39 are in the form of generally T-shaped flat metal and includes a radially extending blade portion 40, a rearwardly extending leg or tail 41 and a forwardly projecting leg or combination member 42. The arrangement is such that the tumblers are slidably received in the tumbler cylinder slots 35 with rearwardly projecting legs 41 positioned radially inward of the springs 38 which in turn bear against the underside of radial tumbler blade portions 40 and the forwardly projecting combination legs 42 ride in the key shaft 32 continuing slots 35. With the current arrangement, though the slots 35 are open, on the periphery of the cylinder 31 insertion of the springs first followed by inserting of the tumblers as described, provides enough self-support and retention that the tumblers will not just fall outwardly during assembly. The radial blade portions 40 of the tumblers can project out without an outer surrounding wall on the tumbler cylinder. This is to be later discussed herein, but suffice it to say that the arrangement will allow the tumbler blade portions 40 to be used for lockup not only at the top but at parts of the peripheral side which will then enable production of locks with system keying and master keying as well as individual lock combinations. The tail or leg portions 41 of the tumblers are made of substantially the same length and project rearwardly with sufficient length such as at least half the length of an uncompressed spring so that the tumbler is not only retained in position by the spring during assembly, but the tail also provides limits to the rearward travel of the tumblers to prevent spring damage by overcompressing that can result even in tangling of the spring coils.

In accordance with another aspect of the present invention, the cam stop washer 44 which has a central opening 45 and a peripheral cutout 46 defining the angular amount of key travel or desired rotation of the lock is positionable over the key shaft 32 such that it surrounds the combination legs 42 of the tumblers slidably carried in tumbler cylinder 31. The washer 44 thereby provides further positive retention of the tumblers during the assembly and also serves as a cover over the tumbler cylinder which conceals the spring bores and covers springs from access through the keyway 18.

Figure 6:
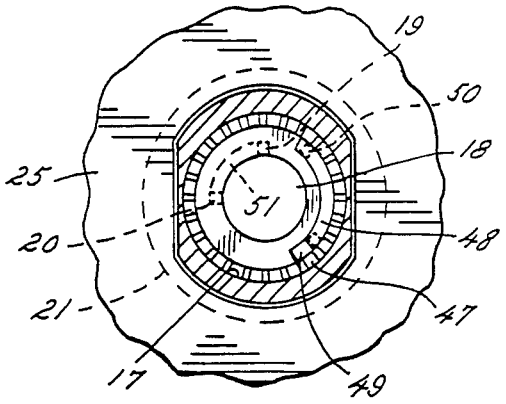
FIG. 6 is a vertical section taken along the line 6—6 of FIG. 4.
Figure 7:
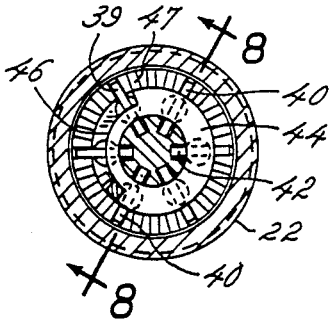
FIG. 7 is a view taken along the line 7—7 of FIG. 3.
Figure 8:
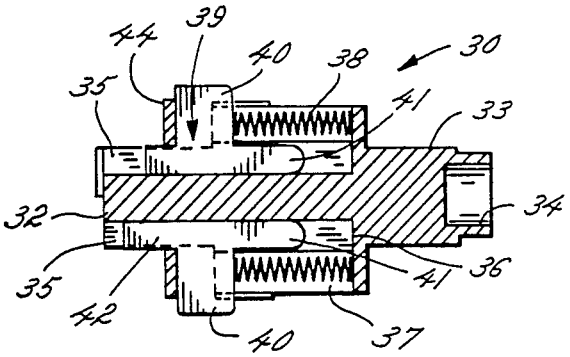
FIG. 8 is a view taken along the line 8—8 of FIG. 7 here showing the cylinder plug, tumbler and cam washer assembly for insertion in the shell.
Figure 9:
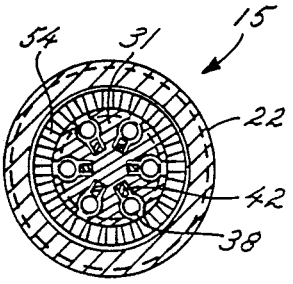
FIG. 9 is a view taken along the line 9—9 of FIG. 4.
Figure 10:
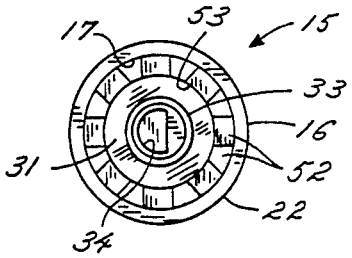
FIG. 10 is a rear elevational view taken along the line 10—10 of FIG. 4.

As viewed in FIG. 6, the underside of the shell head 21 at the end of the longitudinal bore 17 includes at its periphery a plurality of radially extending notches 47 forming a spline arrangement that the forward edges of tumbler blade members 40 can engage with to prevent rotary movement of the tumbler cylinder. In the present instance, there are 24 of such notches 47 disposed about the end periphery of the bore 17 such that the notches are positioned at 15° increments which thereby allows for different angular positions of the keyway notches 19 and 20 besides the illustrative 90° keypull presently depicted. An annular recess 48 internally of the locking notches 47 receives the cam stop washer 44 in the assembled lock with the arrangement being that the washer conceals the spline or notch engagement by the tumblers so that the combination cannot be read by viewing through the keyway. A first fixed stop 49 positioned in the recess 48 co-acts with the cutout 46 of washer 44 and a stop 50 provided on the front face of the cylinder 31 provides a second rotational stop acting with the cutout 46 of washer 44 so that the plug rotation here is limited to 90° corresponding to the key entry and removal notches 19 and 20. As best shown in FIG. 6, there is also provided an additional arcuate recess 51 between the key entry and removal notches 19 and 20 which provides relief for a key guide lug.

In accordance with yet another aspect of the present invention, there is provided an annular rear cap or sleeve 52 having a central bore 53 that slides over the slightly reduced diameter rear portion **31*a* of tumbler cylinder 31. The forward face of the cap sleeve 52 includes a plurality of radially extending notches or splines 54 corresponding in number and angular disposition to the notches or splines 47 in the forward end of the shell bore 17. The sleeve 52 adapted to slide over the tumbler cylinder 31 is received in assembly by the shell and then fixed to the shell to be held stationarily by staking pins 55. In addition, the rearward face of cap sleeve 52 is provided with a plurality of notches 56** that serve to provide locators for angularly positioning the lock with respect to another housing or secondary shell into which the lock may be mounted.

Figure 2:
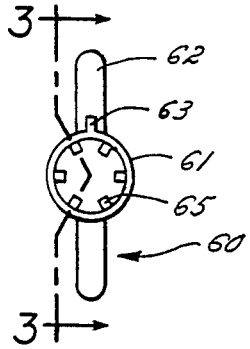
FIG. 2 is a front elevational view of a cast combinated key used with the lock of this invention.
Figure 3:
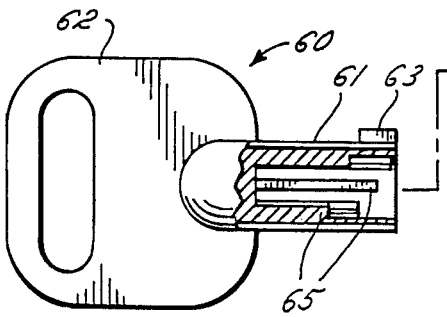
FIG. 3 is a vertical section through the key taken along the line 3—3 of FIG. 2.

Referring to FIGS. 2 and 3, there is illustrated a typical key 60 which has a tubular lock operating portion 61 and the enlarged flattened handle portion 62. The key guide lug 63 is positioned longitudinally at the forward operating end of the tubular portion 61. The interior of the key tubular portion includes a plurality of radial fins 65 which correspond in number to the tumblers and the slots 35 in the actuating shaft 32. The fins 65 are formed of different lengths as determined from the rearward end of the tubular portion 61 or the ends of the fins terminate at or by varying distances from the extreme forward end of the tubular portion 61. This provides the particular key combination that co-acts with the reversely combinated ends 42 of the tumblers that are slidably movable in the shaft 32 and tumbler cylinder 31. It can be seen that the key 60 construction is such that it may be unitarily cast with a plurality of coded combinations thereby enabling mass production of the keys in a single operation without need for the secondary conventional cutting operation used for combinating the keys.

In order to operate the lock, the tubular front end portion of key 60 is inserted in the keyway 18 with the guide lug 63 entering slot 19. The fins 65 of the key engage with the slots 35 of the actuating shaft 32 and when the key is fully inserted, each of the tumbler combination legs 42 is moved by a corresponding key fin 65 rearwardly so that the radial tumbler blades 40 occupy intermediate positions clear of both the forward end shell notches 47 and the rear cap notches 54. With the tumbler blade members 40 free of any notch engagement, the tumbler cylinder can be rotated by the key fins with the key guide lug 63 traveling in recess 45 until it reaches key removal slot 20 for withdrawal of the key. The cutout 46 of cam stop washer 44, together with the stop 50 on the tumbler cylinder and stop 49 on the shell defines the rotational limits of travel for the cylinder spindle plug.

In the foregoing description of the embodiments for the lock construction with respect to FIGS. 1–10, the shell configuration is integrally formed with the head or bezel and the assembly of the lock components in the shell take place through the rear longitudinal shell opening 17. When mounting such a lock to a panel or door, as previously described, the shell is inserted from the front through an opening in the door panel and then secured from the rear side by a nut 24. Referring now to FIG. 11, there is shown an alternative shell arrangement wherein the shell 70 has a tubular threaded body portion with flat 71 and staking pin 72 for the lock assembly, but at the front there is a stepped circular end portion 73 that defines the key opening 74. The annular head or bezel 75 includes a front circular opening 76 to receive the stepped end portion 73 of the shell 70 and the internal periphery includes threads 78 that are interrupted by a plurality of spaced notches 79. Thus, the bezel can be screwed on from the front end of the shell 70.

In order to keep the bezel 75 from being removed when the assembly is mounted, there is provided a washer 80 which has a double-D opening corresponding to the cross-sectional configuration of the shell 70 and a pair of bent outwardly projecting lugs 82 which ride in longitucinal grooves 83 of shell 70 engage with the thread interruption notches 79 on the interior of the bezel. When the lock is mounted as shown in FIG. 12, a nut 84 is applied to the shell 70 behind the mounting surface 86 and the bezel is captively mounted by the washer 80. Furthermore, the bezel includes an inner annular recess 88 such that the washer is totally concealed with the bezel seating flush against the mounting surface.

Figure 14:
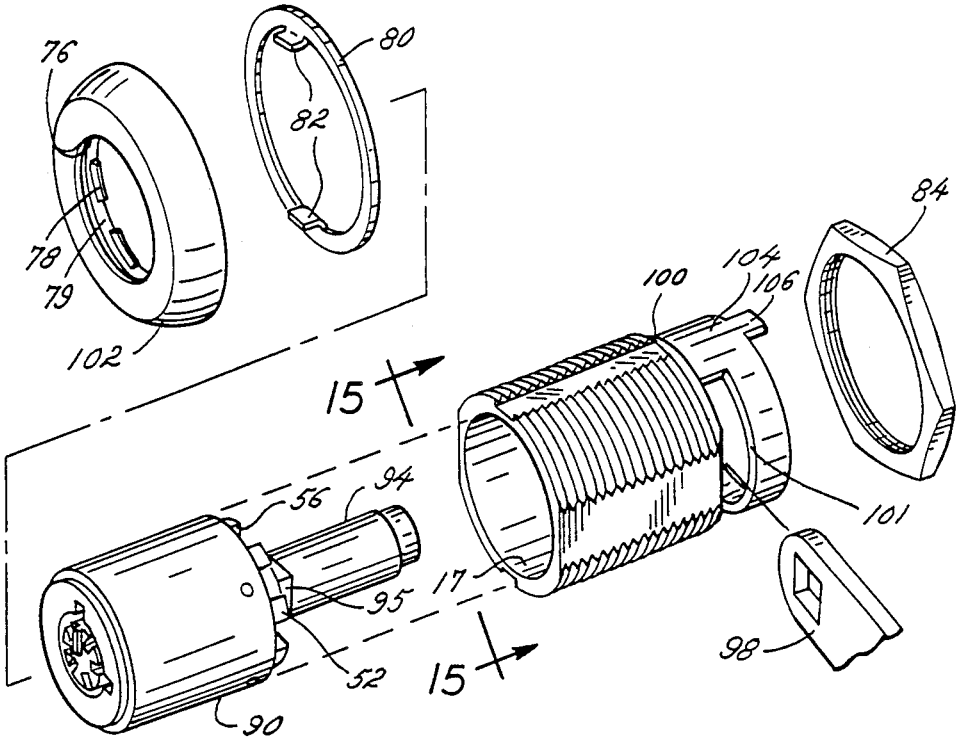
FIG. 14 is an exploded perspective view of another shell embodiment here showing a front loading of a lock assembly for a combination cam and switch lock.

Turning now to FIG. 14, there is shown yet another shell configuration wherein the lock construction of the present invention is encased in its own simple tubular shell 90 with the internal operating elements being the same as discussed with respect to FIGS. 1–10. However, the rearwardly projecting actuating shaft 94, in the present instance has an internal D-shaped bore adapted to receive a switch actuating stem (not shown) and the shaft 94 also includes a rectangular portion 95 that can receive a cam latching member 98. This lock unit is insertable in a secondary outer shell 100 which in the present instance is a front opening tubular member having a threaded exterior and flats for mounting. The latch 98 will project through a slot 101 in shell 100. The screw-on bezel 102, in the present instance, further serves to capture the lock unit within the shell 100. Even through the lock unit is front loading into the secondary shell, with the use of the lugged washer 80 as described in connection with FIGS. 11–13, upon mounting, the bezel is secured in place to prevent the lock unit from being removed from the front.

Figure 15:
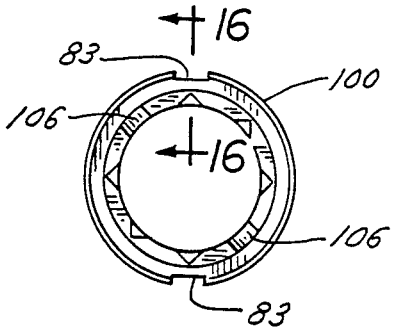
FIG. 15 is a view taken along the line 15—15 of FIG. 14.
Figure 16:
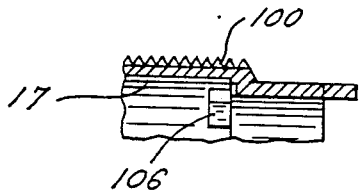
FIG. 16 is a view along the line 16—16 of FIG. 15.

As viewed in FIGS. 15–16, the internal bore of the shell 90 has a radial flange 104 with locating lugs 106 which can receive the notches 56 of rear cap 52 of the locking elements thereby enabling the positioning of the lock within the shell to a large number of possible angular positions according to the desired positions of being key insertion and withdrawal, cam operation or switch actuation.

We claim:

1. In a tubular lock having axial wafer tumblers operable by a tubular key, the combination comprising:

a cylindrical shell having a central bore extending longitudinally from front to rear, a rotatable spindle plug disposed within the shell bore, said spindle plug including a cylindrical portion intermediate its ends, a key receiving shaft projecting forwardly from said cylindrical portion, an actuating member projecting rearwardly from said cylindrical portion, and a plurality of radial slots disposed about the periphery of the key receiving shaft and extending into said cylindrical portion with the cylindrical portion having the same plurality of radial slots disposed about its periphery, each of the cylindrical portion slots having a spring bore extending longitudinally from its front and terminating adjacent the rearward end of said cylindrical portion, a tumbler spring disposed in each of said bores, a plurality of generally T-shaped wafer tumblers having a radially outwardly extending blade portion, a forwardly extending combination leg and a rearwardly extending tail slidably disposed in said slots such that the tail rides in the slots radially inwardly of said springs, and the rearward ends of said blade portions engage said springs, means including a first plurality of notches disposed about the periphery of the shell cylindrical bore at the forward end of the shell positioned to be slidably engaged by forward ends of the tumbler blade portions in the lock-up positions of said tumblers, a second plurality of notches in the front face of a rear sleeve member adapted to be positioned at the rear of said shell bore and fixed to said shell such that slidable movement of the tumblers rearwardly can result in rearward portions of the blade members engaging with the rear notches to maintain lockup, said key shaft being adapted to receive the tubular key having internal radial fins that are combinated longitudinally to engage with the combination legs of the tumblers when the key is positioned around the shaft and inserted to slidably move the tumbler blade portions to an intermediate position free of the front or rear end notches thereby allowing the spindle plug to be rotated within the shell.

2. The tubular lock as claimed in claim 1 wherein the means at forward end of the shell cylindrical bore includes an annular recess disposed radially inwardly of the forward end notches, an annular cam stop washer carried by the key actuating shaft surrounds the combination legs of said tumblers riding within the shaft slots, said cam stop washer having an arcuate cutout portion, and stop means associated with the shell annular recess and rotatable spindle plug cylindrical portion cooperating with said cutout define predetermined rotational limits for said key operated spindle plug.

3. The tubular lock as claimed in claim 1 wherein there are six tumblers and said forward and rearward notches are each disposed at 15° increments totalling 24 notches at each end.

4. The tubular lock as claimed in claim 1 wherein said rear sleeve member includes a plurality of notches disposed on its rear face adapted to provide annular position locating means for said lock.

5. The tubular lock as claimed in claim 2 wherein said shell has a unitarily formed enlarged head at the front end and the spindle plug and rear notch means are assemblable from the rear end of the shell.

6. The tubular lock as claimed in claim 1 wherein said shell has a threaded body and a removable internally threaded bezel is attachable to the front end of said shell.

7. The tubular lock as claimed in claim 6 wherein the internally threaded bezel includes a plurality of longitudinal notches interrupting the threads and an annular washer adapted to be received by the shell body has forwardly projecting lugs which engage with the bezel notches and prevent removal of the screwed on bezel when a lock is attached to a mounting surface.

8. The tubular lock as claimed in claim 1 wherein said shell is adapted to be inserted into a secondary shell and said actuating member has means for receiving a cam latch and actuating means for switch means.

9. The tubular lock as claimed in claim 1 wherein the tumbler tails extend rearwardly by a distance at least half the length of the uncompressed springs to limit the amount of spring compression.

10. The tubular lock as claimed in claim 1 wherein said tubular key is unitarily cast with combinated fins internally which correspond to the tumbler combination of said lock.

11. For use in a tubular lock having a shell with a central bore extending from front to rear and means defining a plurality of notches around the forward end periphery of the cylindrical bore, the combination therewith of a spindle plug having a forwardly projecting key receiving shaft, a rearwardly projecting actuating member and a cylindrical portion intermediate the shaft and member, said shaft and cylindrical portion having a plurality of radial slots disposed about their peripheries, each of the cylindrical portion slots having a spring bore longitudinally extending between the outer and inner ends of the cylinder slots and terminating adjacent the rearward end of the slots, a tumbler spring in each of the bores, a plurality of generally T-shaped wafer tumblers each having a radially outwardly extending blade portion, a forwardly extending combination leg and a rearwardly extending tail slidably disposed in said slots, said tail being radially inward of said springs, an annular washer positioned over the key receiving shaft so as to surround the combination legs and cover the forward face of the cylindrical portion containing the springs, said washer member being adapted to retain the tumblers within the spindle plug during assembly, and an annular sleeve member having notches on its forward face slidably received by a rear portion of said cylindrical portion, said sleeve member being adapted to be fixed to the shell upon assembly of the spindle plug in the shell.

12. The combination as claimed in claim 11 wherein said washer includes a predetermined cutout that together with stop means on the shell and spindle plug define rotational limits of the spindle plug.

* * * * *